United States Patent [19]

Lancaster et al.

[11] 4,317,322

[45] Mar. 2, 1982

[54] ROTATABLE FILM WRAPPING APPARATUS WITH WRAP CARRYING MECHANISM

[75] Inventors: Patrick R. Lancaster, Anchorage; William G. Lancaster, Louisville, both of Ky.

[73] Assignee: Lantech, Inc., Louisville, Ky.

[21] Appl. No.: 151,699

[22] Filed: May 20, 1980

[51] Int. Cl.[3] ..... B65B 13/04

[52] U.S. Cl. ..... 53/399; 53/441; 53/556; 53/588; 100/7; 100/13

[58] Field of Search ..... 53/399, 441, 465, 211, 53/556, 587, 588, 591; 100/7, 13, 15, 27, 28; 493/299, 300, 111

[56] References Cited

U.S. PATENT DOCUMENTS

| | | | |
|---|---|---|---|
| 603,585 | 3/1898 | Crowell | 53/117 |
| 1,417,591 | 5/1922 | Anderson | 46/26 |
| 2,575,467 | 11/1951 | Reichel et al. | 17/34 |
| 2,863,270 | 12/1958 | Elmer, Jr. | 53/117 |
| 3,000,167 | 9/1961 | Pierce, Jr. | 57/3 |
| 3,004,585 | 10/1961 | Lewis | 493/299 X |
| 3,473,288 | 10/1969 | Nakamura et al. | 53/442 |
| 3,514,920 | 6/1970 | Hoffler et al. | 53/117 |
| 3,580,461 | 5/1971 | Dobell | 493/299 X |
| 3,590,549 | 7/1971 | Zelnick | 53/442 |
| 3,596,434 | 8/1971 | Zelnick | 53/442 |
| 3,626,654 | 12/1971 | Hoffler et al. | 53/442 |
| 3,640,048 | 2/1972 | Zelnick et al. | 53/442 |
| 3,662,512 | 5/1972 | Zelnick | 53/442 |
| 3,788,199 | 1/1974 | Sato et al. | 493/196 |
| 3,793,798 | 2/1974 | Lancaster et al. | 53/442 |
| 3,795,086 | 3/1974 | Hiss | 53/442 |
| 3,795,086 | 3/1974 | Hiss | 53/390 |
| 3,863,425 | 2/1975 | Edwards et al. | 53/211 |
| 3,867,806 | 2/1975 | Lancaster et al. | 53/442 |
| 3,986,611 | 10/1976 | Dreher | 206/597 |
| 4,050,220 | 9/1977 | Lancaster et al. | 53/588 |
| 4,077,179 | 3/1978 | Lancaster et al. | 53/587 |
| 4,079,565 | 3/1978 | Lancaster et al. | 53/588 |
| 4,109,445 | 8/1978 | Shulman | 53/588 |
| 4,110,957 | 9/1978 | Lancaster et al. | 53/588 |
| 4,178,734 | 12/1979 | Lancaster et al. | 53/399 |

*Primary Examiner*—John Sipos

*Attorney, Agent, or Firm*—Gipple & Hale; Polster, Polster and Lucchesi

[57] ABSTRACT

The invention comprises a novel apparatus and process for making unitary packages. In the apparatus, a series of loads are fed into a wrapping apparatus onto a wrapping conveying assembly comprised of a plurality of conveyors. The film is wrapped around the load and the conveyor assembly with the load being carried off by the top portion of one conveyor and the wrap being carried off the bottom portion of another conveyor so that the load and wrap are carried off at the same speed onto a take-off conveyor. The stretched film web can be severed by a cutting mechanism positioned adjacent the dispensing means in the banding, full web or spiral modes of operation. In a continuous bundling mode, the wrapped bundle can be transported downstream to a cutting area where the loads are severed into individual packages which are carried off to a stacking or processing station.

42 Claims, 15 Drawing Figures

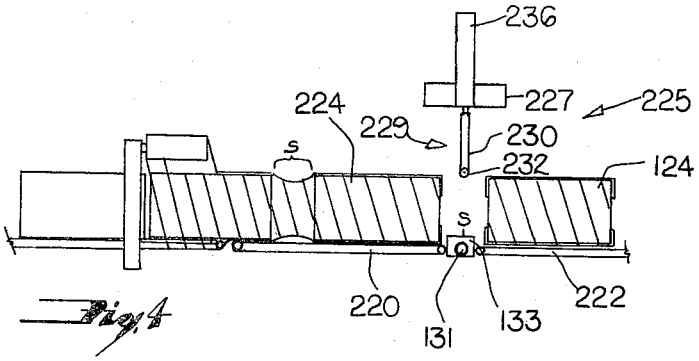
Fig. 4
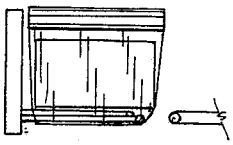
Fig. 5
Fig. 6
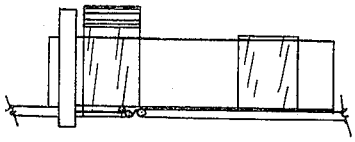
Fig. 7
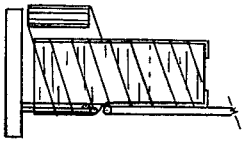
Fig. 3
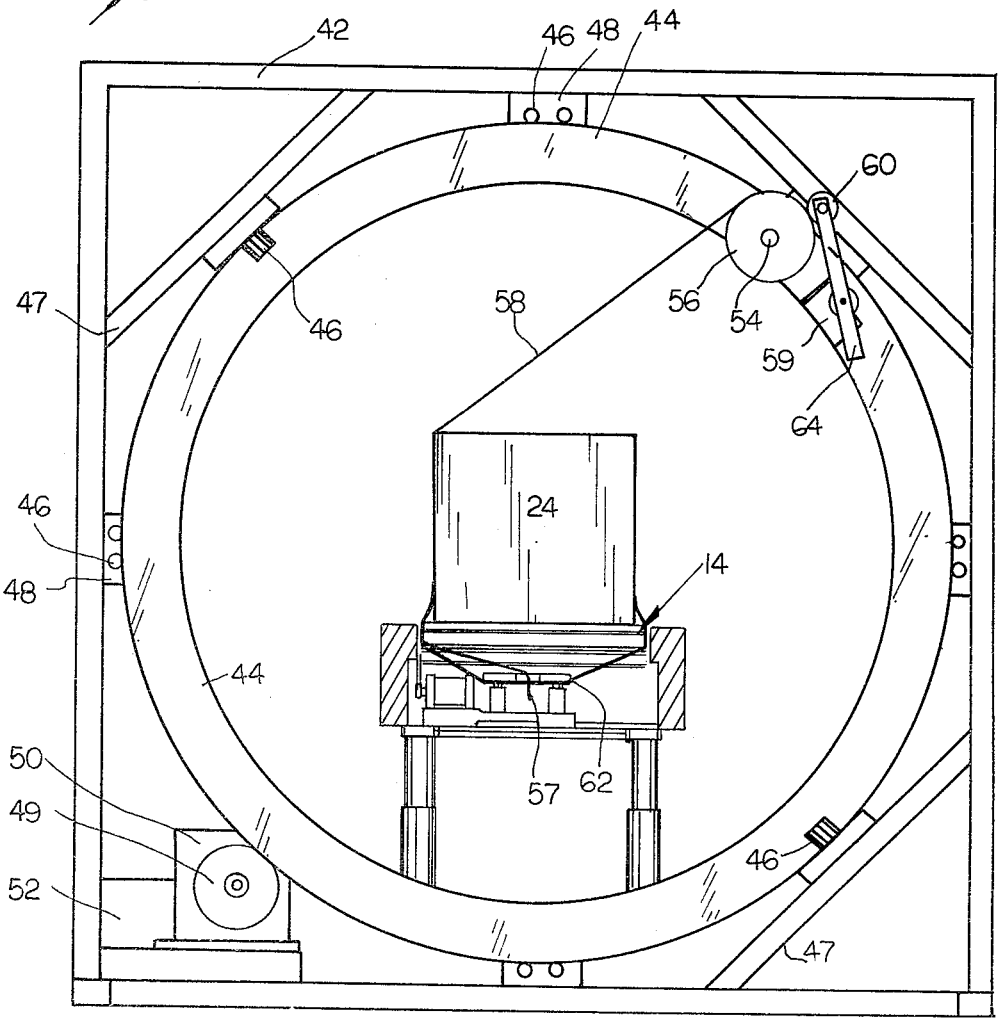

ROTATABLE FILM WRAPPING APPARATUS WITH WRAP CARRYING MECHANISM

BACKGROUND OF THE INVENTION

The present invention generally relates to packaging and more particularly is directed to a rotating stretch wrapping apparatus and method for making unitary packages which hold a plurality of components, each package containing a load wrapped in a web of stretched film.

Case packing or boxing is a common way of shipping multiple unit products. Multiple unit products are generally stacked in a corrugated box or are wrapped with kraft paper with the ends of the kraft paper being glued or taped.

Some manufacturers use strapping of vertical steel of plastic binding to unitize the product. The problems incurred in the use of strapping are the requirement of costly corner protectors, danger of bending or snapping and injuring the operator while applying this high tension material to the loads, the ever present problem of settling due to moisture wetting the cartons, and the sides bulging or normal vibrations causing the straps to loosen and the load to come apart.

Glue is an alternative method used in some areas but customer dissatisfaction with gluing is high because removal of glued cartons or bags from the unitized loads tends to tear outside layers of the cartons. Glue, although an inexpensive material, demands interleaving for product orientation requiring more durable and expensive packaging material.

Because of the lack of alternatives of packaging, tape is currently being used to horizontally bind the top layer of the load. However, tape is expensive and allows relatively free movement of all product surrounded.

Another way of shipping products is by putting a sleeve or covering of heat shrinkable material around the products and shrinking the sleeve to form a unitized package. The use of heat shrinkable film is described in U.S. Pat. Nos. 3,793,798; 3,626,645; 3,590,509 and 3,514,920. A discussion of this art is set forth in U.S. Pat. No. 3,867,806.

The present invention is designed to function with stretchable film webs of plastic material such as nylon, polypropylene, PVC, polybutylene, polyethylene or any copolymer or blends of the aforementioned stretchable films.

A fast growing economical way of packaging products is by wrapping the product load with a web of stretched plastic film.

The elasticity of the stretched plastic film holds the products of the load under more tension than either shrink wrap or kraft wrap, particularly with products which settle when packaged. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application. Containment force is currently achieved by maximizing elongation until just below a critical point where breaking of the film occurs. Virtually all stretch films on the market today including products of Mobil Chemical Company (Mobil-X, Mobil-C, Mobil-H) Borden Resinite Division PS-26, Consolidated Thermoplastics, Presto, PPD and others are consistently stretched less than 30% in applications because of irregularities in film braking systems. These systems depend upon friction induced drag either directly on the film through a bar assembly such as that used by the Radient Engineering Company or indirectly such as that shown in U.S. Pat. Nos. 3,867,806 and 4,077,179.

The use of wrapping machinery to wrap stretched film around a load is well known in the art. Four types of stretch wrapping apparatus are commonly used in the packaging industry and these types are generally described as spiral rotary machines, full web rotary machines, passthrough machines, and circular rotating machines.

A spiral machine is shown in U.S. Pat. No. 3,863,425 in which film is guided from a roll and wrapped around a cylindrical load in a spiral configuration. A carriage drives the film roll adjacent the surface of the load to deposit a spiral wrap around the load and returns in the opposite direction to deposit another spiral overwrap around the load.

In U.S. Pat. No. 3,788,199, tapes are spirally wound in such a manner that they overlap each other to provide suitable space therebetween when breatheability is required. In this disclosure, a heavy duty bag is prepared by spirally winding stretched tapes of synthetic resin in opposite directions, so that they intersect each other to form a plurality of superimposed cylindrical bodies which are bonded together to form a cylindrical network. The spirally wound inner and outer tapes of the superimposed cylindrical body intersect each other at a suitable angle, depending upon the application intended, the preferred embodiment having substantially equal longitudinal transfer strength. In this preferred embodiment, the tapes intersect each other at an angle of about 90°. The angle defined by the tapes constituting the cylindrical network may be determined by varying the interrelationship between the travelling speed of the endless belts carrying the tape and the rotating speed of the bobbin holders, which rotate a plurality of tape bobbins to deposit the tape onto the moveable belt.

Spiral wrapping machines which are currently commerically available are manufactured by Lantech, Inc. under Model Nos. SVS-80, SVSM-80, STVS-80, STVSM-80 and SAHS-80.

A full web type of apparatus which wraps stretched film around a rotating load is disclosed in U.S. Pat. No. 3,876,806 assigned to Lantech, Inc. A similar full web apparatus using a tensioned cling film wrapped around a rotating load is shown by U.S. Pat. No. 3,986,611 while another apparatus using a tacky PVC film is disclosed in U.S. Pat. No. 3,795,086.

Full web wrapping machines typical of those presently commercially available are Model Nos. S-65, T-65 and SAH-70 manufactured by Lantech, Inc.

Another type of machine for wrapping a pallet load commonly called a pass through machine is disclosed in U.S. Pat. No. 3,596,434. In this reference a pallet load is transported along a conveyor and the leading face of the pallet load contacts a vertical curtain of film formed by the sealed leading edges of film webs dispensed by two rolls of film on opposite sides of the path of the pallet load. The pallet load continues to move along the conveyor, carrying with it the sealed film curtain until the two side faces of the pallet load as well as the front face are covered by film web. A pair of clamping jaws then close behind the pallet load, bringing the two film web portions trailing from the side faces of the pallet load into contact with one another behind the pallet. The jaws then seal the film web portions together along two vertical lines, and cut the web portions between those two seals. Thus, the film web portions are connected to cover the trailing face of the pallet load, and the film curtain across the conveyor is re-established to receive the next pallet load. The pallet load may subsequently be exposed to heat in order to shrink the film web and apply unitizing tension to the load, as is disclosed in U.S. Pat. No. 3,662,512. Another disclosure of relevance to pass through wrapping is U.S. Pat. No. 3,640,048 which shows that film may be applied to the top and bottom of the pallet load prior to the wrapping cycle when it is desired to cover all six surfaces of the pallet load with film. Commercial pass through machines are currently manufactured by Weldotron, Arenco, and SAT of France.

Various apparatus and processes have been developed to rotatably wrap stacked components to form a load.

Stationary loads which are brought to a loading area and are wrapped by a rotating member which dispenses stretched film around a load are disclosed in U.S. Pat. Nos. 4,079,565 and 4,109,445. U.S. Pat. No. 4,079,565 discloses a full web vertical wrap of the load while U.S. Pat. No. 4,109,445 discloses the horizontal spiral wrap of a load. U.S Pat. No. 4,050,220 issued to the inventors of the present invention discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll of material is rotated about the load and the supporting planar surfaces, wrapping the load and the supporting surfaces together. Plastic wrapping material is stretched during the wrapping operation so that the material is under tension when applied to the load. After the wrapping cycle is complete, the load is pushed past the ends of the supporting surfaces, and the wrapping material which covered the supporting surfaces collapses against the supported sides of the load. Further developments of this wrapping system by the inventors of the present invention are disclosed in U.S. Pat. Nos. 4,110,957 and 4,178,734.

U.S. Pat. No. 603,585 discloses a spiral wrapping device for enclosing individual newspapers in paper wrap for mailing purposes. Each newspaper is placed on a cylindrical core with a circumference approximately twice that of a newspaper, and each newspaper advances along the length of the core as the core is rotated. Wrapping paper is applied to the core at an angle and the wrapping paper between newspapers is severed as each newspaper reaches the end of the cylinder and is placed on a flat horizontal surface, thereby collapsing the wrapping paper against the underside of the newspaper previously pressed to the cylinder.

U.S. Pat. No. 1,417,591 discloses a wrapping machine for individual items such as boxes in which each such item is conveyed along the surface of a horizontal sheet of wrapping material. The edges of wrapping material on each side of an item are curled upward to meet one another atop the item to be wrapped thereby forming a tube around the item. The leading end of the tube is sealed and the trailing end of the tube is severed and then sealed to enclose the item. Another device which utilizes this system of wrapping is disclosed in U.S. Pat. No. 3,473,288.

In U.S. Pat. No. 2,575,467, a wrapper of cylindrical packages for material such as sausage is disclosed in which the package is rotated about its cylindrical axis as wrapping tape is applied at an angle to form a cylindrical wrap.

In U.S. Pat. No. 2,863,270, two cylindrical items of approximately equal diameter are abutted at their planar ends, and placed by hand in a cradle which exposes the complete circumference of the abutting ends. A roll of wrapping material is then driven by a hand crank mechanism to circulate around the circumference of the abutting ends, applying wrapping material thereto. When sealed together, the pair of cylindrical items are removed from the cradle by hand.

A spiral wrapping machine for long bundles of items such as filaments is disclosed in U.S. Pat. No. 3,000,167. As the bundle of filaments moves along its axis through the wrapping area, a ring circulates about the bundle carrying a roll of wrapping material which is applied to the bundle to form a spiral wrap pattern. Because the normal load of filaments or similar items is much longer than the wrapping area, it is not necessary to provide support for the bundle in the wrapping area and therefore no support structure is wrapped with the bundle.

Commercial circular rotating wrapping machines are presently manufactured by Lantech Inc. under the trademark LANRINGR and are provided with wrapping ring inner diameters of 36 inches, 54 inches, 72 inches and 84 inches. In differentiating between the various circular rotating wrapping machines manufactured by Lantech Inc., the manual model has the designation SR; the full web models have the designations SVR and SAVR; the multiple banding models have the designation SVBR and SAVBR; the spiral models have the designation SVSR and SAVSR and the continuous wrap or bundler models have the model designations SVCR and SAVCR.

In these commercial machines, the load is pushed onto support tongues or wrapping rails and the load and support tongues are wrapped by a rotating supply of film. The film is stretched as it is rotated from the dispenser and the stretched film wrap holds the load together under compressive forces and also engages the tongues or wrapping rails on which the load is supported. The load is then pushed off or carried off of the tongues by the following load or take off conveyor respectively with the attendant frictional forces which result from the film engaging the tongues. Such forces can cause disorientation of the load.

It is apparent that the friction forces increase as the width of the tongues increase. However, the friction forces also increase the closer that the tongues approach the corners of the load. Thus, prior art devices have had to utilize wrapping rails or tongues which did not extend past the corners or side edges of the load and have also had to contend with the problems of load support. While narrower tongues are preferred to reduce friction forces, strength requirements generally are such that because the bottom of the product or total weight of the load is supported, by tongues, the tongues are necessarily thicker and wider and increase the friction forces. In addition, the problem of removal of the wrapped load from the tongues has caused difficulties, since the present way to remove wrapped packages has been to push the packages from behind. While the use of tongues or wrapping rails are effective when long loads are used, these tongues become less effective when smaller loads are wrapped. Also many wrapped packages which contain products having low weight, slippery composition or fragile composition cannot be used with existing rotating wrapping apparatus.

Another inherent problem with the use of the fixed rails and tongues is that change of product sizes causes problems in operation of the apparatus, requiring changes in the sizes of the tongues and in the spacing between the tongues and the take-off conveyor. If the product is moved through the wrapping area, the wrapping web projects off the dispenser at an angle requiring more space than that required when a single band is provided over the wrapped load.

Other problems which occur include film tearing on the tongues when the load is being pushed off of the tongues along with product abrasion. Thus, bolts of cloth can become indented, metal pieces scored and product dented or crushed by passage over the tongues.

Another large problem inherent in presently existing apparatus arises when products are run in a continuous spiral wrap mode. In this particular wrapping mode, the take off conveyor is run faster than the infeed conveyor giving separation between the products allowing the cutter bar to reciprocate between loads so the loads are formed into individual wrapped loads. In current apparatus large individual articles such as bags of sugar are placed on the conveyor to be wrapped as for example a load 6 bags long, 3 bags across, and it is desired that the six long bags come in as a single load. Under present apparatus when the take-off conveyor runs faster, each row is separated from the next which precludes the ability to wrap multiples of anything having more than one unit in depth along the length of the conveyor.

The present invention overcomes the previously discussed problems in existing machines by utilizing a novel conveyor assembly which transports the stretched film web at the same speed as the load is carried through the dispensing area, thus providing a stronger wrap and eliminating disorientation, film tearing, product abrasion and friction problems inherent in the prior art. Furthermore by using the present invention, there is no problem with the load width in regard to the supporting conveyor as the supporting conveyor can be wider than the load and the friction problems of the tongue support are not present. In addition, there isn't as much need to change the size of the tongues to support different weights and lengths of loads, or to make sure that there is sufficient space to hold the film from the film ring to cover the angle formed between the product and the stationary ring.

SUMMARY OF THE INVENTION

The present invention generally comprises a novel apparatus and process for making a wrapped unitary package. In the apparatus a series of loads each containing a plurality of units are fed into a rotating wrapping apparatus having a film web stretching mechanism and film dispensing mechanism and the load is covered by a plurality of layers of stretched film to form a unitary package. The load as it is fed into the rotating wrapping apparatus is carried through the wrapping station by a conveyor assembly having an upper conveyor which carries the load in a downstream direction and a lower conveyor mounted under the load carrying conveyor. The lower portion of the endless belt of the lower conveyor travels at the same speed and in the same direction as the upper portion of the endless belt of the load carrying conveyor so that stretched film wrapped around the load and conveyor assembly is carried by the lower conveyor at the same speed and in the same direction as the load is carried by the upper conveyor. The wrapped load is transported to a take-off conveyor spaced from the conveyor assembly allowing the wrap to be transported off of the conveyor assembly to assume a memory position around the load before it is carried off by the take-off conveyor. After each load is wrapped in the banding, full web or spiral mode, the conveyor assembly is stopped and the film web is cut from the film dispensing mechanism by a pivoting cutter mechanism. When the mode of wrap is the continuous spiral mode, the cutter mechanism is not used and continuously spiral wrapped loads are transported to a cutting area where the loads are separated from the bundle into unitary packages which are then carried off to a stacking or processing station. Thus, it can be seen that the apparatus provides a novel conveyor transport assembly in combination with the wrapping apparatus.

The conveyor assembly holding the load and stretched film web eliminates friction problems which are inherent in prior art wrapping systems and eliminates the need for changing the spacing required to accomodate the web angle formed between the load and the wrapping ring. Furthermore, the conveyor assembly can easily handle random sized loads of varying composition so that there is no need to change tongue or wrapping rail sizes to accomodate change of product size, change of product weight, or product composition. In addition, the conveyor assembly does not require the loads to be pushed from the rear to move them through the wrapping station. The ability of the present invention to power banded, full web or spiral wrapped bundles away from the wrapping station significantly reduces film tear, product abrasion, and load alignment after the load leaves the wrapping station to the take-off conveyor.

Although the invention is set forth in the claims, the invention itself and the method by which it is made and used may be better understood by referring to the following description taken in connection with the accompanying drawings forming a part hereof, in which like reference numerals refer to like parts throughout the several views and in which:

BRIEF DESCRIPTION OF THE DRAWINGS

FIG. 3 is an enlarged rear elevational view of the invention shown in FIG. 1;

FIG. 4 shows a continuous spiral bundling type of wrap utilizing packages which have been continuously wrapped by the invention;

FIG. 5 discloses a full web mode of wrap accomplished by the inventive apparatus;

FIG. 6 discloses a banding mode of wrap accomplished by the inventive apparatus;

FIG. 7 discloses a spiral mode of wrap accomplished by the inventive apparatus;

DETAILED DESCRIPTION OF THE DRAWINGS

Figure 1:
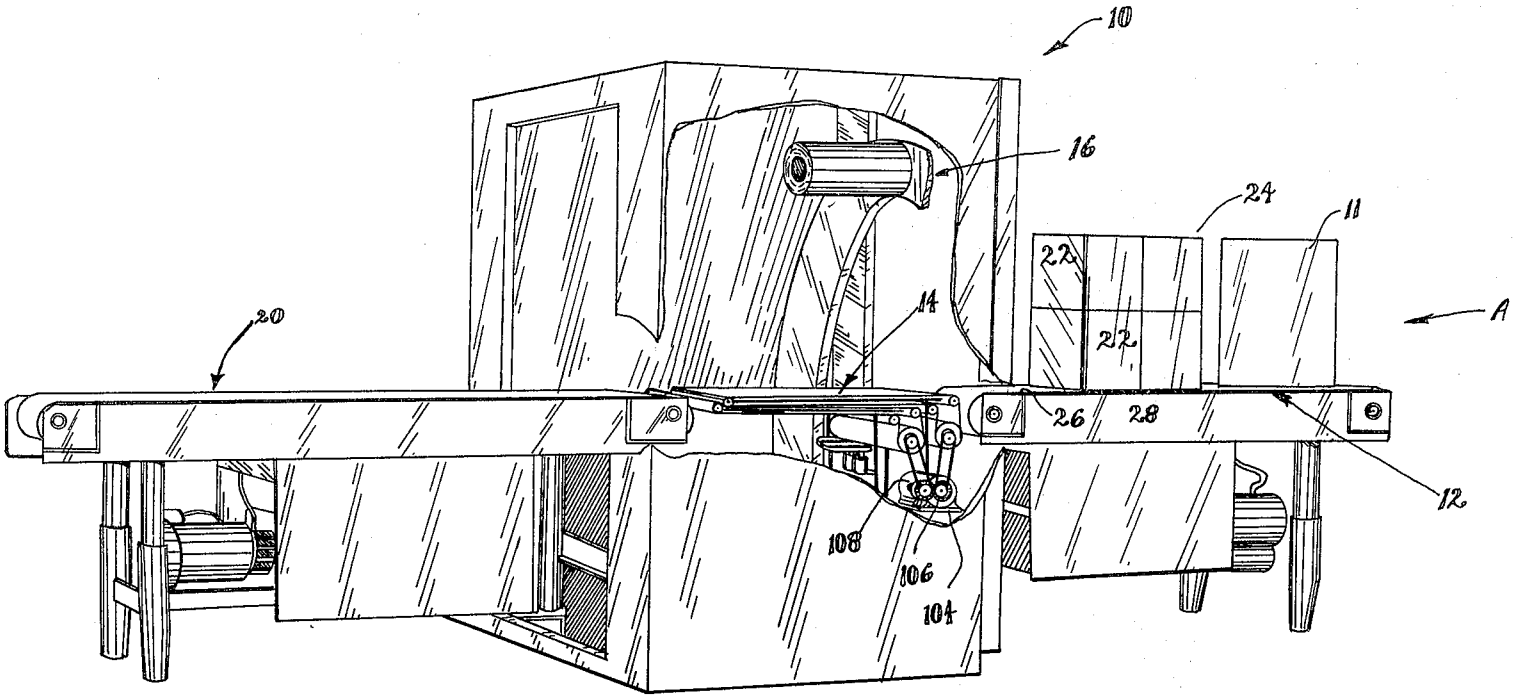
FIG. 1 discloses a perspective view of the invention partially broken away disclosing the inventive apparatus.

The present invention as disclosed in FIGS. 1 through 12 shows a ring wrapping apparatus 10 comprising a feed conveyor 12, a wrap and load conveyor assembly 14, a film dispensing mechanism 16 with a cutting mechanism 18 and a take-off conveyor 20.

As shown in FIG. 1, a plurality of cartons 22 forming a load 24 have been loaded in a stacked relationship on an infeed conveyor assembly 12 by either manual or mechanical means. It should be noted that the load, depending on its nature and composition, may or may not require spacing. The loading device 11 is schematically shown and may be one of a number of types of stacking or placing devices which are well known in the art to place a stack of cartons or materials into designated areas.

In the preferred embodiment, the load 24 is placed on an infeed conveyor 12 which is comprised of an endless belt 26 mounted on frame support 28.

An alternate embodiment of the infeed conveyor could take the form of a hydraulic or pneumatic pushing device (not shown) which can be used to engage each load 24 with a platen to push the load into the wrapping area. However, the conveyor embodiment is preferred and the belts of the conveyor of the present invention are preferably textured so that they have a high coefficient of friction.

Figure 2:
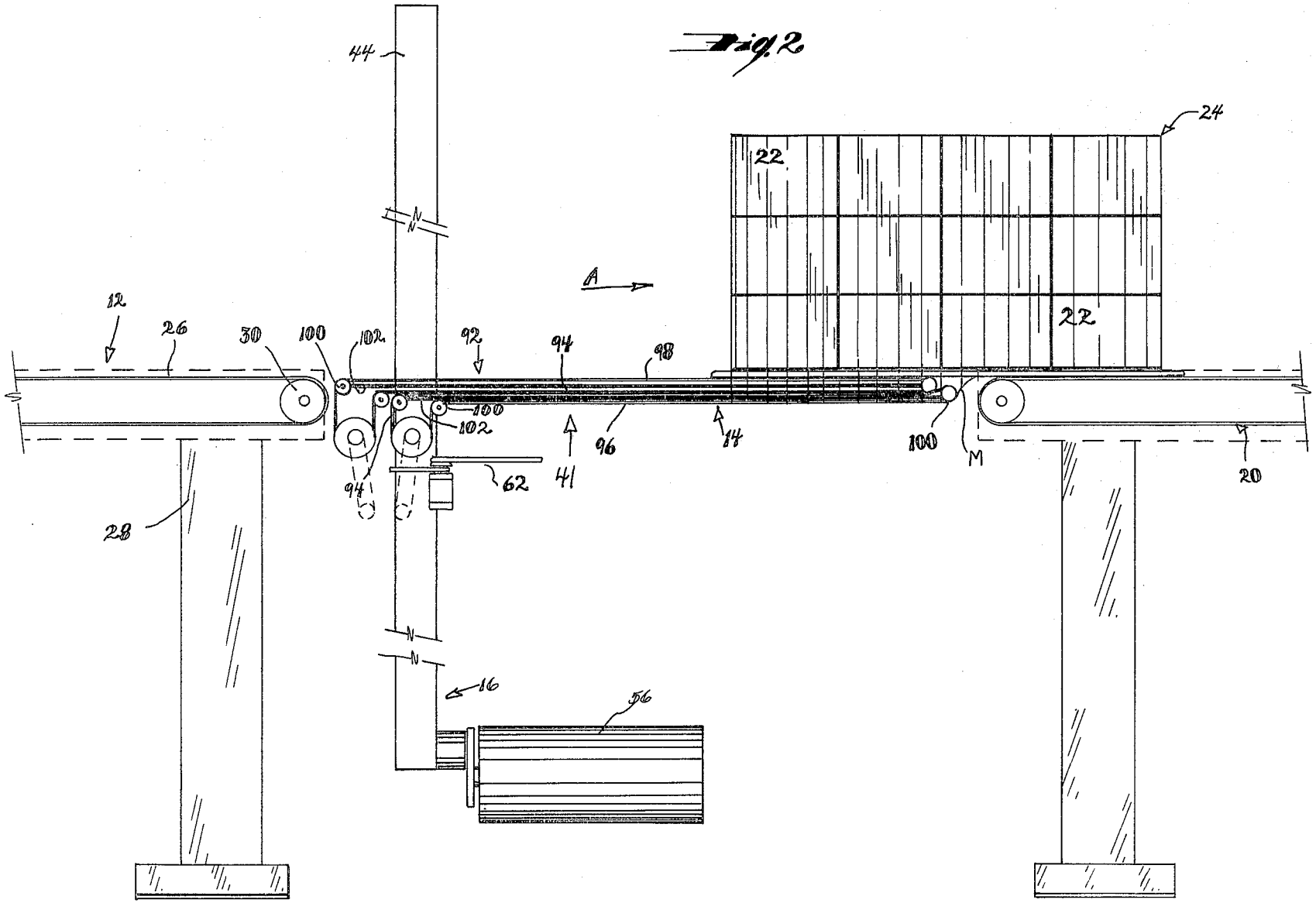
FIG. 2 discloses an enlarged reversed side elevational view of the invention as shown in FIG. 1.
Figure 8:
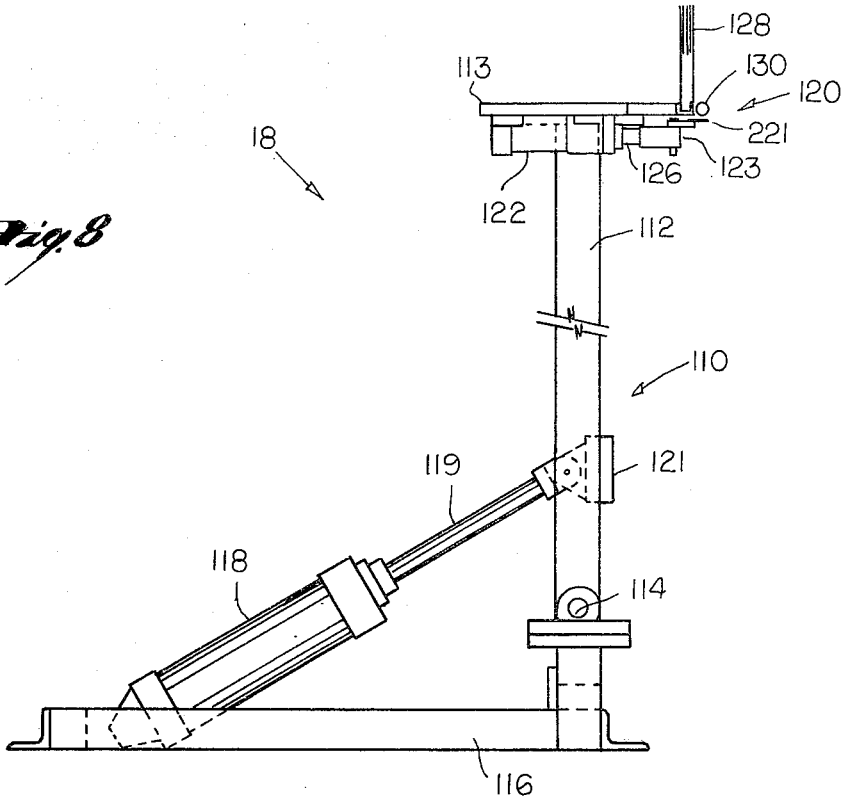
FIG. 8 discloses a side elevational view of a web severing mechanism used in the invention.

The particular arrangement of the conveyors set forth in FIGS. 1 and 2 lends itself to random variation of total load size in all three dimensions. It is apparent however that other configurations could be constructed which would be advantageous for specific products. Thus, the conveyance of 12 packs or 6 packs of cans or bottles could be handled by a horizontal conveyor with guide conveyors on each side.

The conveyor belt 26 as seen in FIG. 2 is mounted on rollers 30 which are rotatably journalled by suitable bearing means in brackets which are secured to the frame support 28. The infeed conveyor 12 carries the loads 24 onto a wrapping station 41 comprising a film dispensing apparatus 16, and a wrapping conveyor assembly 14.

The preferred embodiment and best mode of the invention comprises a frame 42 on which a steel "donut" or ring shaped film support member 44 is rotatably mounted and supported on three planes by guide rollers 46. If desired, the film support member can be constructed of aluminum. A plurality of guide rollers 46 project inward from the frame 42 on arms 47 and mounting plates 48 to engage the ring shaped member so that it can be driven in a predetermined path. A friction drive wheel 49 is positioned adjacent the ring member 44 at its base and engages the member 44 to rotate the member 44 within the guide wheel rolling area. The friction drive wheel 49 is driven by a motor 50 having a shaft which is suitably connected with a drive reducer 52. A material roll dispensing shaft 54 is rotatably secured to the ring member 44 for rotation on its axis and is adapted to receive and hold a roll of film material 56.

Typical films which can be used in the stretch wrapping apparatus are EVA copolymer films with a high EVA content such as the films manufactured by Consolidated Thermoplastics "RS-50", Bemis "Super-Tough" and PPD "Stay-Tight" films. PVC films such as Borden Resinite "PS-26" can be used in the invention along with premium films such as Mobil-X, Presto Premium and St. Regis which utilize a new low pressure polymerization process resin manufactured by Union Carbide and Dow Chemical Company. This resin, called linear low density polyethylene, has significantly different stretch characteristics than previous stretch films. These characteristics allow the film to withstand the high stress of extreme elongation without tearing during wrapping of the load.

It should be noted that film, film material and film web are used interchangeably throughout the specification.

In the preferred braking assembly used with the best mode of the invention and illustrated in FIG. 3, a film roll friction brake mechanism 59 is mounted to the ring shaped member 44. The brake mechanism 59 engages the surface of the film roll 56 with a roller member 60 rotatably mounted to support arm 64 to maintain constant tension on the film material. This constant tension allows the film web to cover the load with the desired degree of stretch provided on the film. The leading edge 57 of the web of stretchable material 58 is withdrawn from the roll 56 without tension and is placed in a rotating clamp assembly 62 adjacent the initial load before tension is applied. However, if desired, the leading edge can be placed under initial tension.

The brake mechanism 59 controls the force of arm 64 and its associated roller member 60 in engagement with the roll 56 to accomplish the braking process. The roller member 60 is constantly urged against the film roll 56 with a controlled force to provide a constant tension on the film roll and stretch the film 58 as it is being wrapped around the load 24.

Figure 10:
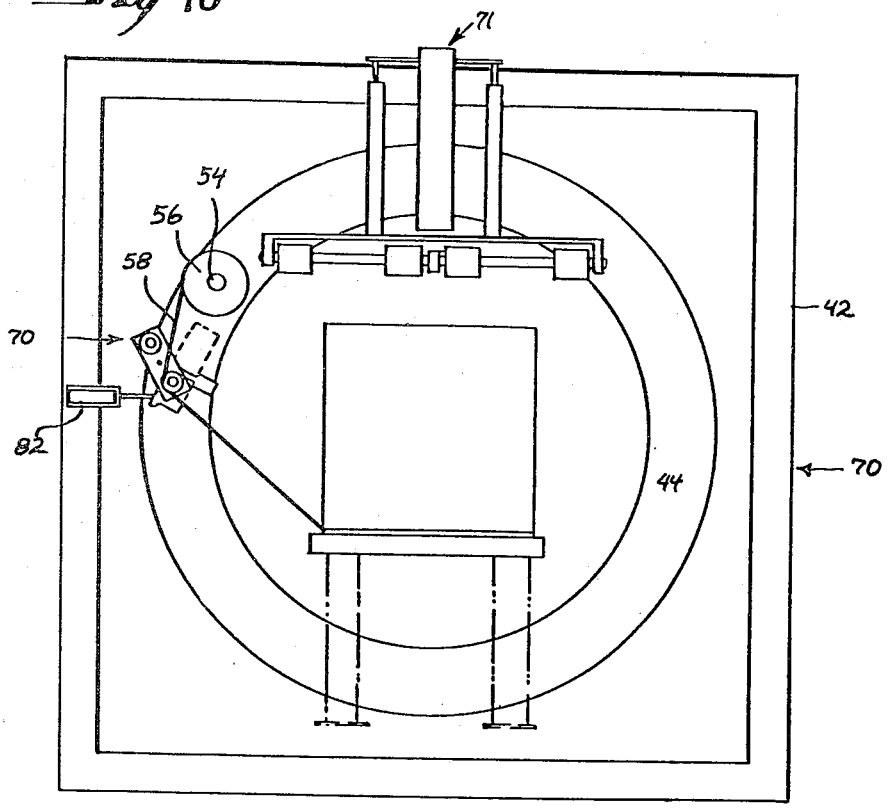
FIG. 10 is a rear elevational view of the invention with an alternate web stretching embodiment.
Figure 11:
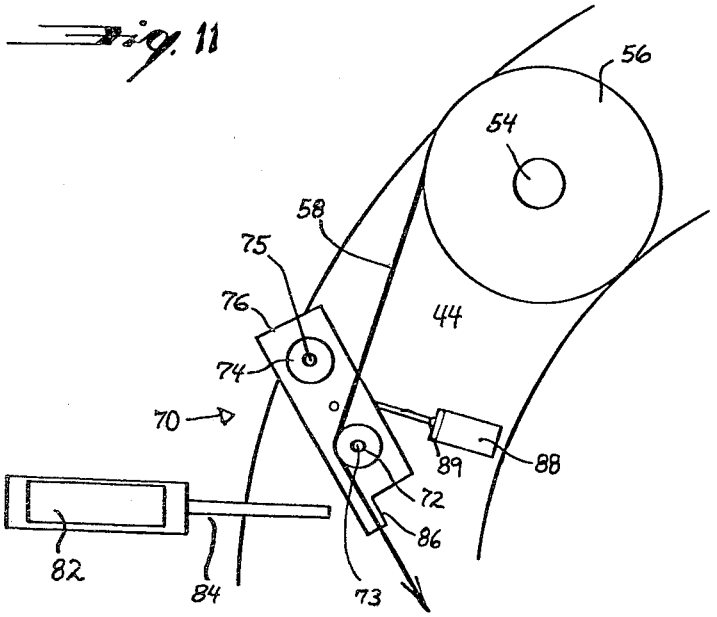
FIG. 11 is an enlarged elevational view of the alternate web stretching embodiment shown in FIG. 10.
Figure 12:
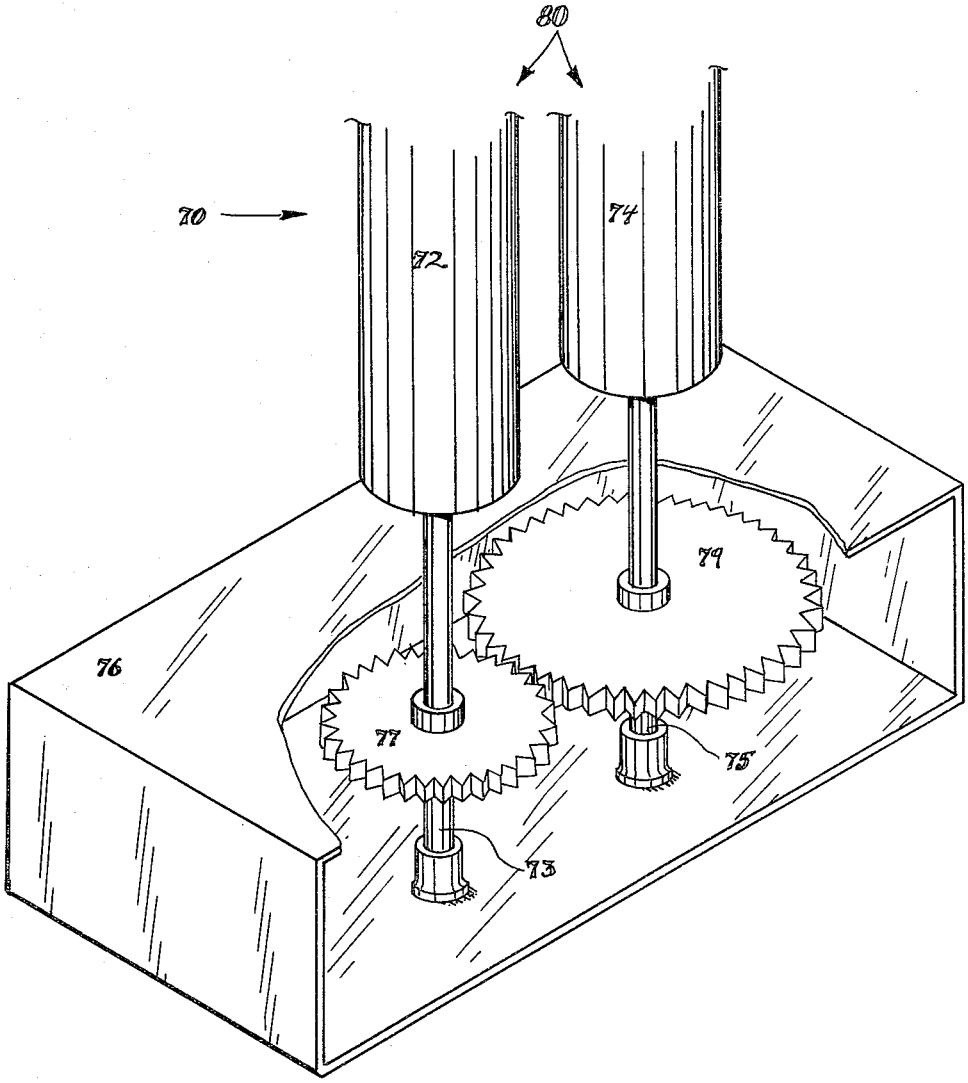
FIG. 12 is a perspective broken away view of the gear gear assembly used in the film web stretching embodiment.
Figure 13:
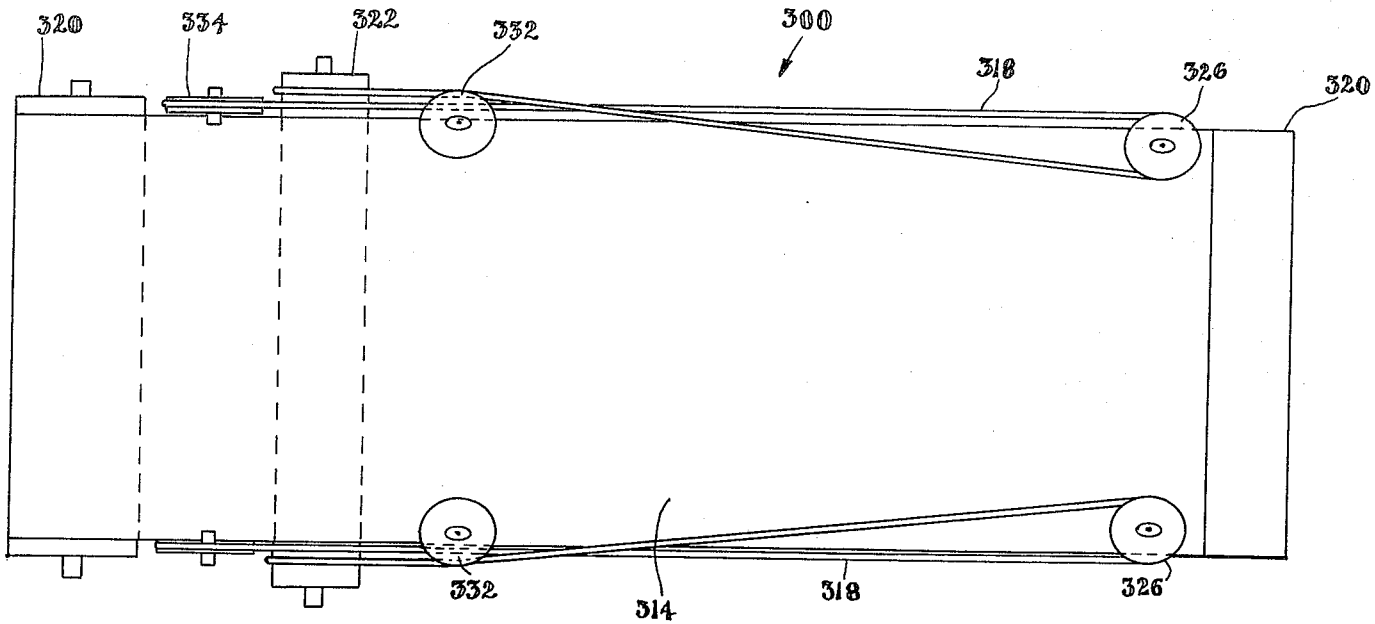
FIG. 13 is a top plan view of an alternate embodiment of the conveyor assembly with the belt and slider plate removed.

An alternate film stretching embodiment as shown in FIGS. 10 through 12 can be used to stretch the film web. In this embodiment the film web is passed through a prestretching assembly 70 and is tucked or fastened underneath the load as shown in FIG. 10 or held in clamp assembly 62. The prestretching mechanism 70 comprises connected roller members 72 and 74 which are rotatably mounted on respective shafts 73 and 75 which are in turn journalled into a housing 76. The housing 76 is rotatably mounted by means of a pivot assembly (not shown) to the ring member 44. The rollers 72 and 74 are connected together by gears 77 and 79 as shown in FIG. 12, which mesh together and are driven as the film web engages the rubber roller surfaces driving the rollers. The gears 77 and 79 operate so that the film web will drive the downstream roller 72 at a faster rate than the upstream roller 74 causing the film to be stretched between a narrow space 80 of the two rollers. The ratio of the gear 77 to the gear 79 ranges from 4:5 to 1:3. The prestretching mechanism 70 is pivotable so that the film may be threaded through the mechanism and wrapped around the load 24 in a substantially unelongated condition until such time that the first corner of the load is covered with unstretched film.

Before the start of the film wrap, a pneumatic cylinder 82 mounted to frame 42 is activated causing piston rod 84 to extend outward and engage the cam portion 86 of housing 76, pushing the cam portion inward to the center of the ring so that roller member 74 does not engage the film web. Since the connected roller members do not both engage the film web, the film web can be easily threaded through the stretching mechanism and tucked or held under the load 24. After the leading edge 57 of the film has been placed under the load, the wrap cycle is activated by the operator and the piston rod 84 is retracted into the pneumatic cylinder away from the housing 76. A coil spring (not shown) engages the housing and is connected to a shaft which is rotatably mounted to constantly urge the housing 76 away from the center of the ring member 44 so that both roller members 72 and 74 engage the film web. A fluid damper 88 of a type well known in the art is secured to the ring member and engages the side of the housing 76 to prevent the roller member 74 from engaging the film web when stretching is not desired. The piston 89 of the damper is provided with a suitable orifice allowing the force of the coil spring to gradually push the piston rod and its associated piston inward at a predetermined speed allowing an appropriate amount of unelongated film web to be rotated around the load.

If desired, a pneumatic load stabilizer 71 can be used to stabilize the top of the load.

The wrapping conveyor assembly 14 as best seen in FIGS. 1 and 2 comprises two stacked conveyors 92 and 94. These conveyors are standard plate-type conveyors well known in the art comprising driven endless belts 96 and 98 mounted on a plurality of rollers 100. The rollers are supported by plates 102 secured in turn to a frame member (not shown) which holds the rollers in a rotatable position. The endless belt 96 is rotated in a direction A shown by the arrow in FIG. 2 and travels at the same speed as endless belt 98. Both belts are driven by a motor assembly 104 shown in FIG. 1 which is connected by gear means 106 and linkage 108 in the form of chains or belts to drive the conveyors. The upper segment of conveyor 92 travels downstream with the lower segment travelling upstream. The upper segment of conveyor 94 travels upstream while the lower segment travels downstream. The upper and/or lower conveyor can comprise multiple belts.

This construction allows a web of film to be wrapped around a load 24 which was carried from the infeed conveyor 12 onto the wrapping station 41. The stretched wrap of web is wrapped around the conveyor assembly 14 and the load with both the load and wrap being carried by the conveyor assembly in the same direction. In the full web, spiral and banding modes, the conveyor assembly and wrapping ring is stopped, the clamp apparatus 62 clamps the film web and the cutter mechanism 18 severs the film web. The conveyor assembly 14 is activated carrying the load and wrap downstream to a take-off conveyor 20. When the load encounters the take-off conveyor 20 as shown in FIG. 2 the elongated stretched web coming off of the end of the conveyor assembly assumes its memory position M against the load in the space between the conveyor assembly 14 and take-off conveyor 20, allowing the contained load covered by stretched wrap to be carried away.

The cutting mechanism 110 used in the preferred embodiment and best mode of the invention incorporates a driven pivoted standard which is adapted to be projected upward to engage the film web between clamping apparatus 62 and the load 24. The cutting mechanism 110 comprises a support standard 112 which is pivotally mounted at 114 to a base member 116. The base member 116 can either be a part of frame 42 or be secured to frame 42. A pneumatic lifting cylinder 118 has one end mounted by a suitable ear or bracket attachment to the base member 116 with the end of its piston rod 119 attached to the support standard 112 by suitable means such as a yoke member 121. Upon activation of the pneumatic cylinder, the upright standard 112 is transported in an arcuate path into the film web 58. Mounted to the support standard is a cutting assembly 120 comprising a support plate 113, a pneumatic cylinder 122 mounted to the support plate 113 and a cutting blade assembly 123 mounted to the piston rod 126 of cylinder 122. A brush 128 is vertically mounted on the support plate to brush down the trailing edge of the web against the conveyor assembly. A bumper member 130 is positioned in front of brush 128 to protect the brush base from initial contact with the film web and conveyor assembly. Upon appropriate activation as for example a predetermined number of revolutions of the ring member, which is sensed by an appropriate sensor device which will be discussed later in the specification, the cutting mechanism 110 is propelled upward so that the cutting assembly 120 engages the film web. The blade assembly 123 subsequently severs the film web from the load. If desired, the cylinder 118 can be activated after cutting to propel the standard 112 forward a predetermined distance causing the brush 128 to engage the remainder of the trailing edge of the film web and wipe it against an underlying film layer.

The conveyor assembly 14 leads from the infeed conveyor 12 to a take-off conveyor 20 which is constructed like the infeed conveyor and runs at the same speed as the infeed conveyor. In order to control both conveyors at the same rate of speed a suitable mechanical means (not shown) is set up to make the drive of both the infeed conveyor and the take-off conveyor equal to reduction gearing assembly of the drive motor. Thus, if the motor slows down or speeds up to drive the wrapping mechanism at different speeds, the infeed and take-off conveyors are simultaneously speeded up or slowed down so that the load is moved to conveyor assembly 14 and taken away from the conveyor assembly 14 at consistent relative speed.

In an alternate mode of wrapping, continuously wrapped loads are taken off of the apparatus and are severed into separate loads away from the apparatus. In this embodiment, the take-off conveyor 220 carries the continuously spiral wrapped loads as shown in FIG. 4 connected together by the film overwrap from the wrapping station. The take-off conveyor assembly 220 carries the spirally wrapped bundle onto cutting conveyor 222.

The wrapped spiral bundle 224 as seen in FIG. 4 is severed into individual packages by a guillotine-like cutting apparatus 225 comprising a frame 227 and a cutter mechanism 229 slidably mounted to the frame. The cutter mechanism 229 consists of a bow frame 230 strung with high nichrome wire 232 which is electrically connected to a source of energy. The resistance of the wire causes sufficient heat so that when the wire is reciprocated between the encapsulated loads 224 to cut them apart, the film material is simultaneously bonded to the edges so that the film will not unravel in shipment. As the wrapped loads 124 of the spiral bundle 224 enters the cutting area, a sensor 131 projects a light source through the transparent film in a space S between the individual loads against a photoelectric reflector 133 to generate an electrical signal commanding the cutter blade drive circuitry to activate a pneumatic cylinder 236 driving the hot cutter wire 232 through the film to sever the load 124 from the wrapped spiral bundle 224. Such sensing apparatus are well known in the art, and any standard circuit can be used to cause the pneumatic cylinder 236 to be activated when the sensor senses a space between loads 124. Likewise, a limit switch, contact switch, pressure sensitive switch or other suitable means can be used to activate the cylinder 236. In operation the bow 230 is driven downward during one cut and driven upward on the next cut to provide smooth, efficient operation.

The wire is heated by connecting it to a current source of about nine volts which heats the wire sufficiently so that the edges of the film are bonded to form a holding edge. The severed edge stretches back to its original memory shape to form the holding shape. The spiral bundle advances and the next spacing S between the loads 124 is sensed by the light sensor 131. The cutting wire 232 which has been previously driven down is lifted upward severing the wrapped loads in the same manner as previously discussed.

Other cutting apparatus can be used in place of the heating cutting wire, namely a knife blade with sawtooth edges secured to the frame in place of the cutter wire. When the blade is driven against the film the cutting edge strikes the wrapping material substantially causing the wrapping material to shear. The cutting is done while the wrapped bundle is being transported by the conveyors.

Figure 14:
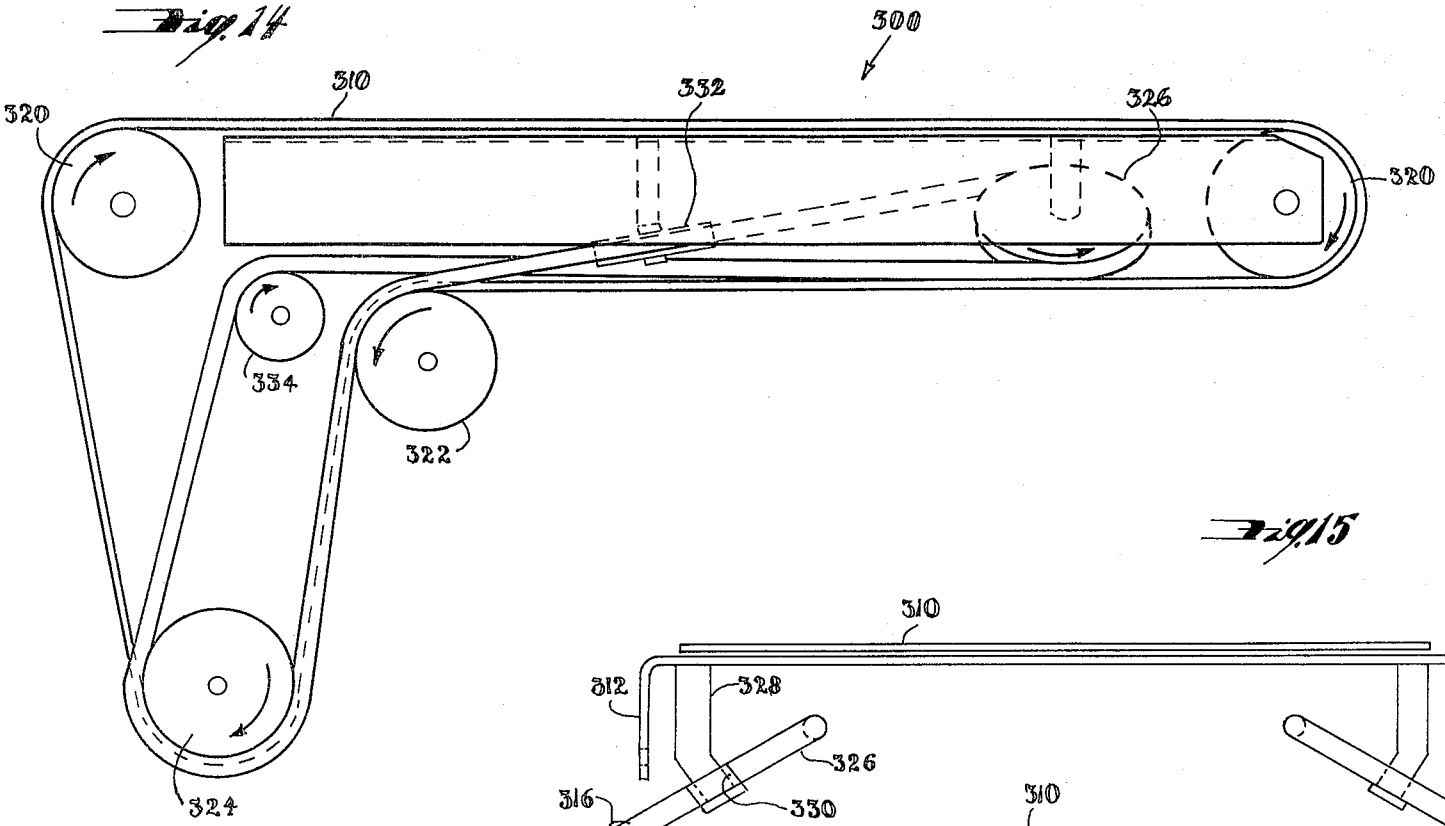
FIG. 14 is a side elevational view of the conveyor assembly shown in FIG. 13.
Figure 15:
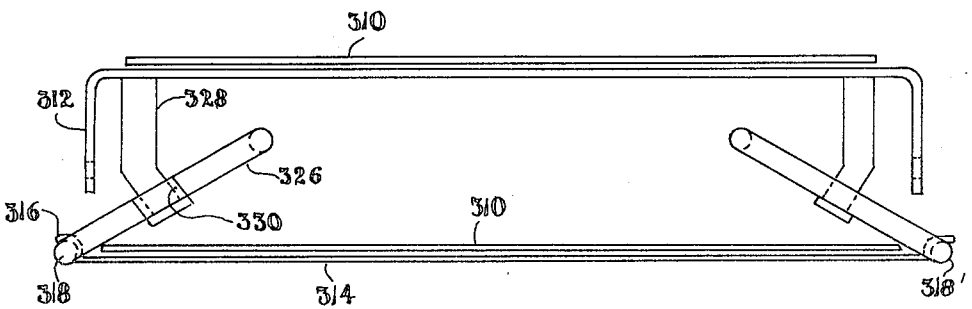
FIG. 15 is a front cross sectional view taken along line 14'—14' of FIG. 14.

An alternate conveyor assembly embodiment 300 can be used in place of the conveyor assembly previously disclosed. In this embodiment, the load carrying belt 310 as shown in FIGS. 14 and 15 is positioned over a steel slider bed 312 which can be suitably mounted to a frame or upstanding supports. Also secured to the frame or supports are a steel base plate 314 with guide rails 316 formed on each side to form channels to contain the round belt 318. The belt 318 is of a standard commercial type well known in the art. The load carrying belt 310 is mounted on rollers 320,322 and is driven by roller 324 as is well known in the art. Belt 310 which is of the same composition as the conveyor belt which has previously been described has a friction surface which enables it to carry a load suitably along its surface. The round belts 318 and 318' are respectively mounted on either side of conveyor assembly 310 on downstream pulleys 326 which are mounted to shafts 328 by means of roller bearing assemblies 330. The belt is positioned by alignment pulleys 332 and 334 which are also rotatably mounted to shafts which are in turn secured to the frame or in case of pullies 326 and 332 to the steel slider bed 312. The round belts 318 and 318' are mounted on the outside of belt 310 around roller 322 and driver roller 324. Thus, it can be seen that rather than using the lower conveyor structure, which has previously been described, a round belt conveyor is utilized which engages only the outer edges of the film web wrapped around the conveyor assembly. In this embodiment there is a short distance of approximately two to three inches between the end of the downsteam pulley 326 to the edge of roller 320 so that the web of film will engage to a slight extent the tip of the conveyor assembly. However, since the web is being carried forward friction forces do not build up unlike those of prior art devices. The operation of the wrapping apparatus is the same as that of the preferred embodiment.

In the operation of the inventive wrapping apparatus, the full web, spiral web and banding modes of operation are operated in a substantially identical manner. In these modes, a feed conveyor 12 brings the load 24 onto the wrapping conveyor assembly 14 which then carries the load to a predetermined wrap position within the film dispensing path and the conveyor assembly stops, leaving the load in a stationary position. The leading edge 57 of the film web 58 is held in clamping assembly 62 located beneath the conveyor assembly 14 as is best seen in FIG. 3. After at least one wrap has been made around the load and the clamp assembly, the clamps are rotated releasing edge 57 which is held by the film web wrap. If the wrap is for a full web load as shown in FIG. 5 or a banded load as shown in FIG. 6, a plurality of overlying layers of film are wrapped around the load and the conveyor assembly 14. In the spiral wrap mode as shown in FIG. 7, a plural number of wraps are wrapped around the downstream end of the load as shown in phantom in FIG. 7 in the same manner as the banding in FIG. 6 and the conveyor assembly is activated carrying the load downstream to a take-off conveyor so that a spiral wrap is formed around the load. When the load reaches a station where the end is sensed by a feeler gauge, light sensing means, pressure sensitive switch or other suitable sensing mechanism, both the take-off conveyor and wrapping conveyor assembly stop and a second band is placed around the upstream end of the load in the same manner as if a band or full web wrap were being wrapped around the load. It should be noted that there is a space between the conveyor assembly 14 and the take-off conveyor 20 allowing the stretched film web, which has been stretched at least 10%, by either the braking system as previously described or over 40% by the prestretching mechanism which has been described, to be discharged from the conveyor assembly and assume its memory position M around the load.

Figure 9:
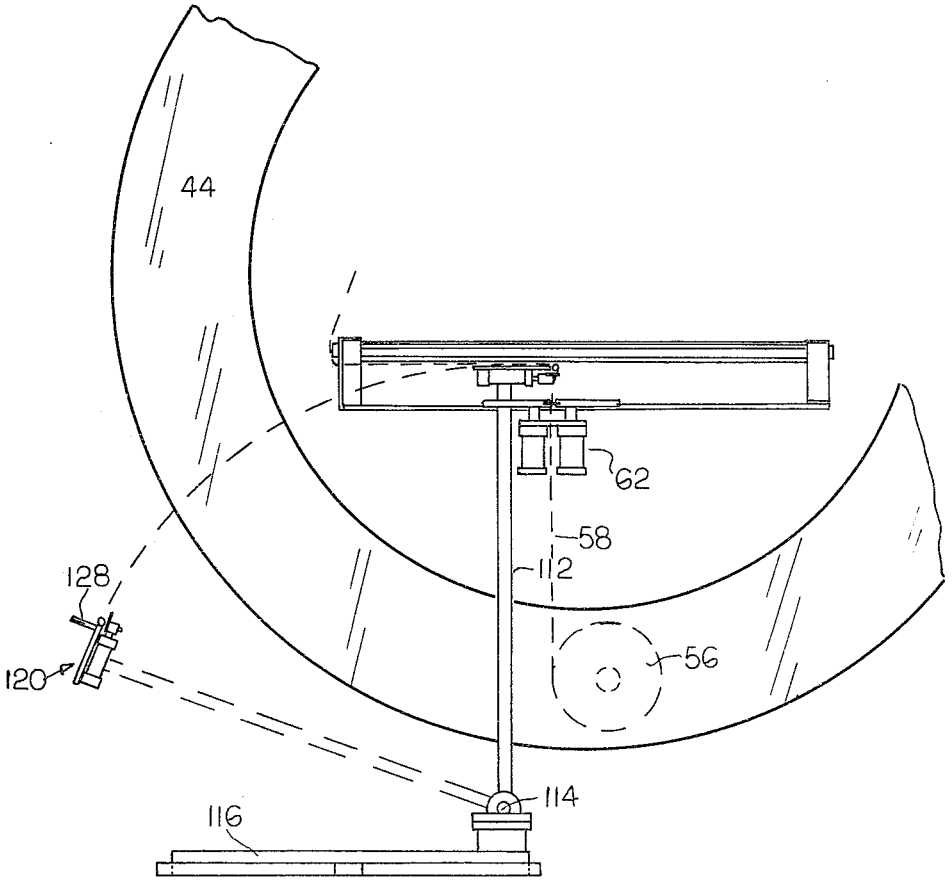
FIG. 9 discloses a front elevational view of the web severing device shown in different positions during cutting of the film web.

The end of the wrap cycle is determined in the present invention by a proximity switch located a short distance away from ring 44 which senses a bent metal plate secured to the ring. The proximity switch is electrically connected to a counter which is activated to determine each revolution of wrap. The particular counter which is utilized is an Eagle counter, Model D2100-AG which is an off-the-shelf standard apparatus. When the counter has indicated a predetermined number of revolutions determined by the type of wrap and the load desired to be wrapped, the counter activates a switch which stops the take-off conveyor and wrapping conveyor assembly for cutting of the film web. The activation of the fluid cylinders to fire in a predetermined order and extend a predetermined distance is well known in the art and can be accomplished by common fluid circuitry. When the cutter mechanism is activated, the cutter standard and head is directed upward and abuts the film carrying the film to the middle of the load. It should be noted that the dispensing roll 56 on ring 44 in the stop position is located underneath the load and is substantially perpendicular to the axis of the load. When the film roll has been positioned in this manner, the web itself has engaged either the load edge or conveyor assembly edge and is angled from that edge down towards the roll positioned on the ring. The cutter mechanism 110 when it is driven upward by the pneumatic cylinder 118 engages the angled film web and carries it into substantial conformance with a perpendicular line drawn from the center axis of the conveyor assembly with the brush 128 brushing the film down over an underlying film layer wrapped around the conveyor assembly as is shown in FIG. 9. The clamping mechanism 62 is then rotated to clamp and hold the film web between the cutter head 120 and the dispensing roll 56. The pneumatic cylinder 122 of the cutting head is then fired, driving a sawtooth cutter blade 221 into the film web 58 to sever the film web. When the film web is severed, a small portion of the trailing edge is left hanging free from the wrap. If desired, this film edge may be wiped onto the load by firing the cutter standard cylinder 118 a second time so that the standard moves a short distance further on carrying the brush on to wipe the remanent edge against the wrap. The cutter standard is then withdrawn away from the load into a rest position as shown in phantom in FIG. 9 for the next cutting operation and the conveyors are activated to carry the wrapped load away from the wrapping station and a new load into the wrapping station.

In the continuous wrapping operation, the previously described cutter mechanism is not used and the loads are continuously carried along the wrapping conveyor assembly onto a take-off conveyor which spaces the loads for severing downstream. The loads are then severed between the spaced film areas as previously discussed and taken away to another transport area.

It should be noted that the steps of the wrapping process can be interchangeable without departing from the scope of the invention. Furthermore, these steps can be interchanged and are equivalent. In the foregoing description, the invention has been described with reference to a particular preferred embodiment, although it is to be understood that the specific details shown are merely illustrative, and the invention may be carried out in other ways without departing from the true spirit and scope of the following claims:

What is claimed:

1. Apparatus for wrapping a load comprising infeed means adapted to receive a load, a wrapping means positioned adjacent said infeed means, said wrapping means comprising a frame and a film dispensing means rotatably mounted on said frame, said film dispensing means when rotated defining a wrapping area, a conveyor assembly positioned within said wrapping area, said conveyor assembly comprising at least two conveyor means positioned within said wrapping area and driven at substantially the same speed, one of said conveyor means being adapted to receive a load from said infeed means and transport said load, said film dispensing means being adapted to hold a roll of film material and wrap said film material around the load and conveyor assembly, drive means connected to said dispensing means to drive said film dispensing means around the load and conveyor assembly to contact and wrap the other conveyor means of said conveyor assembly with film dispensed from said film dispensing means enabling the wrapped load on the one conveyor means and film web wrapped around the other conveyor means to be carried linearly by both conveyor means at substantially the same speed to a take-off conveying means spaced from said conveyor assembly, and film stretching means mounted to said dispensing means engaging said film to substantially stretch the film being dispensed from said film dispensing means.

2. Apparatus as claimed in claim 1, wherein said film stretching means comprises brake means mounted to said film dispensing means, said brake means being adapted to engage the outer surface of a roll of material mounted on said film dispensing means to place uniform tension on said roll substantially stretching the material being dispensed from said roll onto said load.

3. Apparatus as claimed in claim 1 wherein said film stretching means is mounted to said film dispensing means and comprises at least two connected and spaced apart roller means driven by the film web and pulled from the material roll so that the downstream roller transports the film web faster than the upstream roller to cause the film material to elongate between the rollers before it reaches the load.

4. Apparatus as claimed in claim 3 wherein said connected and spaced apart roller means comprise at least two roller members mounted on a shaft with gear means mounted to said shaft and interconnected together.

5. Apparatus as claimed in claim 4 wherein said connected gear means have a ratio of the upstream gear to the downstream gear ranging from 4:5 to 1:3.

6. Apparatus as claimed in claim 1, including cutting means comprising a base, a support member pivotally mounted on said base, means to pivot said support member on said base, and a cutter assembly mounted to said support member.

7. Apparatus as claimed in claim 6 wherein said cutter assembly comprises a support plate mounted on said support member, a fluid cylinder mounted to said support plate, a piston rod mounted in said fluid cylinder and a cutter member mounted to said piston rod.

8. Apparatus as claimed in claim 7 including a brush member mounted to said support plate, said brush member extending outward from said support plate and adapted to engage the trailing edge of the film web and brush said film web against an underlying wrap.

9. Apparatus as claimed in claim 7, wherein said cutter member comprises a sawtooth blade.

10. Apparatus as claimed in claim 1 including cutting means comprising a reciprocating bow member with a heated member mounted to said bow member, and a heat source connected to said heated member.

11. Apparatus as claimed in claim 1 including cutting means comprising a reciprocating bow member and a double edged knife blade mounted to said bow member.

12. Apparatus as claimed in claim 1 including counter means mounted to said frame and cutting means to sever said film web, said counter means being adapted to sense the rotation of said film dispensing means, said counter means ascertaining a predetermined number of revolutions and thereupon activating said cutting means through circuit means.

13. Apparatus as claimed in claim 1 including sensor means positioned downstream from said conveyor assembly and cutting means to sever said film web, said sensor means comprising light transmission means adapted to transmit light through said material overwrap to sense the spacing between the loads, said spacing when sensed by said sensor means causing activation of said cutting means.

14. Apparatus as claimed in claim 1 including sensor means positioned downstream from said conveyor assembly, said sensor means comprising a pressure sensitive means adapted to sense the position of the wrapped load and cause activation of said cutting means.

15. Apparatus for wrapping a plurality of loads, comprising; conveyor means adapted to receive a plurality of loads, wrapping means positioned adjacent said conveyor means, said wrapping means comprising a frame, a rotatable film roll support member mounted on said frame, said film roll support member when rotated defining a wrapping area, a conveyor assembly aligned with said conveyor means and positioned within the wrapping area of said film roll support member, said conveyor assembly comprising two vertically positioned conveyors mounted to a frame, drive means to drive said conveyors so that the upper portion of one conveyor travels in the same direction as the lower portion of the other conveyor with said one conveyor supporting and linearly conveying said load, a rotatable shaft secured to said film roll support member adapted to hold a roll of material, drive means connected to said film roll support member to rotate said film roll support member so that it continuously dispenses the material around the said conveyor assembly and the load being supported by the one conveyor to contact and wrap the load and said other conveyor forming a spiral wrapped load; film stretching means connected to said film roll support member to place tension on said film material causing the film material to be substantially stretched when wrapped around said load and conveyor assembly, a take off conveying means positioned adjacent to said conveyor assembly to carry the spirally wrapped load from said wrapping means; and a cutting means positioned downstream from said take off conveying means, said cutting means being adapted to cut between adjacent loads through film material wrapped around said loads while said loads are being transported to separate each load into a unitary package.

16. Apparatus for wrapping a plurality of loads and unitizing the loads into wrapped packages comprising conveyor means adapted to receive a plurality of loads, each said load comprising a plurality of members, a wrapping means positioned adjacent said conveyor means, said wrapping means comprising a frame, a ring member rotatably mounted on said frame, the inner diameter of which defines a wrapping area, a film dispensing means rotatably mounted on said ring member adapted to hold a film roll, a conveyor assembly aligned with said conveyor means adapted to receive said load from said conveyor means, said conveyor assembly extending into said wrapping area at least from the end of the film roll nearest the ring member past the film roll and forming a planar surface for said load, said conveyor assembly comprising at least two conveyors positioned adjacent each other in a stacked relationship and driven at substantially the same speed, one of said conveyors of said conveyor assembly being adapted to receive a load from said conveyor means and transport said load in a downstream direction through and away from said wrapping area, another of said conveyors being adapted to receive and carry film web wrapped around it in said downstream direction, said wrapping means dispensing film from said film dispenser around said load and the lowest conveyor with the film web engaging and being carried by said lowest conveyor at substantially the same speed as the load is being carried by the one conveyor of the conveyor assembly, said film dispenser means being adapted to wrap film material from said roll of film around the load, drive means connected to said film dispenser means to drive said dispenser means so that it deposits film material around said load and conveyor assembly, film stretching means engaging said film to place tension on said film and substantially stretch the film being dispensed from said roll, a take-off conveyor means spaced away but positioned adjacent to said conveyor assembly to carry said wrapped load away and cutting means to cut through said stretched material overwrapping said load.

17. Apparatus as claimed in claim 16 wherein said film stretching means comprises brake means mounted to said film dispensing means, said brake means being adapted to place uniform tension on said film material substantially stretching the material being dispensed from said roll onto said load.

18. Apparatus as claimed in claim 16 wherein said film stretching means is mounted to said ring member and comprises at least two connected and closely spaced apart rollers driven by the film web pulled from the film roll so that the downstream roller transports the film web faster than the upstream roller to cause the film material to elongate between the roller members before it reaches the load.

19. Apparatus as claimed in claim 16 including sensor means mounted to said frame, said sensor means comprising a proximity switch mounted on said frame and a plate mounted to said ring member, said sensor means activating counter means to count and record the number of revolutions of said ring, said counter means being connected to switch means which stops the drive motor of said ring member to position the film roll on said ring member beneath said conveyor assembly.

20. Apparatus as claimed in claim 16 wherein said film material is plastic.

21. Apparatus as claimed in claim 16 including clamp means positioned below said lowest conveyor adapted to clamp and hold said film web dispensed from said roll of film, said clamp means being rotatable in a plane which is substantially parallel to the plane of the conveyor assembly.

22. Apparatus as claimed in claim 16 including positioning means connected to said frame for positioning said ring member so that said film roll is positioned under the conveyor assembly.

23. Apparatus as claimed in claim 16 wherein said cutting means comprises a pivotable support assembly, said support assembly comprising a base member and a standard pivotably mounted to said base member, fluid cylinder means mounted to said base member and connected to said standard, said fluid cylinder means being adapted to be activated to rotate said standard into an upright position, a cutter support plate mounted to said standard, a second fluid cylinder mounted to said support plate and connected to cutting means, said second fluid cylinder being adapted to reciprocate said cutting means forward so that a blade member mounted on said cutting means reciprocates outward to engage and sever said film web.

24. Apparatus as claimed in claim 23 wherein said blade member is a sawtooth blade.

25. Apparatus as claimed in claim 16 including means to activate said conveyor assembly and drive said conveyor assembly a predetermined distance and stop said conveyor assembly.

26. Apparatus as claimed in claim 16, wherein said cutting means comprises a reciprocating frame with a heated wire mounted thereon, said reciprocating frame being adapted to reciprocate above and below the continuously wrapped loads so that on one stroke it cuts down through the space between the loads and on the subsequent stroke it cuts up through the space between the loads.

27. Apparatus as claimed in claim 16, wherein said cutting means comprises a reciprocating guillotine blade which cuts through the space between the loads while the loads are moving.

28. A process of making a banded unitary package comprising the steps of:

(a) placing a plurality of loads each of which is comprised of a plurality of stacked members on a conveying device in a spaced apart relationship;

(b) transporting each load sequentially to a conveyor assembly positioned within a wrapping apparatus, said conveyor assembly comprising upper and lower conveyors, the upper of which supports the load and has the upper portion of its belt moving in a downstream direction, and the lower of which has the lower portion of its belt moving in said downstream direction at the same speed as the upper conveyor;

(c) stopping the conveyor assembly within a wrapping area of said wrapping apparatus;

(d) wrapping a band of material which has been substantially stretched from said wrapping apparatus around said load and conveyor assembly a plurality of times to engage said load and the lower belt portion of the lower conveyor to form a single band;

(e) severing said single band from said wrapping apparatus while holding the new leading edge of said band for subsequent wrap;

(f) activating said conveyor assembly to carry said load and said band wrapped around said conveyor assembly a predetermined distance along a linear path;

(g) stopping said conveyor assembly and wrapping a second band around said load and said conveyor assembly;

(h) severing said film web from said wrapping apparatus; and (i) activating said conveyor assembly to transport said load with a plurality of bands of stretched material wrapped thereon to a take-off conveyor, said take-off conveyor being spaced from said wrapping apparatus a sufficient distance to allow each wrapped band of material to regain its memory position around the load before it completely encounters the take-off conveyor.

29. A process of making a full web wrapped unitary package comprising the steps of:

(a) placing a plurality of loads, each of which is comprised of a plurality of stacked members on a conveying device in a spaced relationship;

(b) transporting said plurality of loads until one of said loads is placed on a conveyor assembly aligned with said conveying device, said conveyor assembly being positioned within a wrapping apparatus and comprising a plurality of conveyor mechanisms;

(c) withdrawing a leading edge of a web of stretchable material from said wrapping apparatus and holding said leading edge adjacent said first load;

(d) causing said web of stretchable film material to be substantially stretched and wrapping concentric revolutions of said stretched material around said first load and conveyor assembly to engage said load and said conveyor assembly;

(e) severing said stretchable material from said wrapping apparatus, and holding the new leading edge of material for a subsequent wrap;

(f) transporting said full web wrapped load to a take-off conveyor spaced from said conveyor assembly by activating said conveyor assembly so that two of its conveyor mechanisms have outer positioned surfaces moving in a substantially linear downstream direction and one of the two conveyor mechanisms supports said load and the other is engaged by the film web; and (g) allowing the film web wrapped around the conveyor assembly to return to a memory position around the load in the space between the conveyor assembly and the take-off conveyor.

30. A process as claimed in claim 29 wherein the at least one of said conveyor mechanisms comprises multiple belts.

31. A process as claimed in claim 29 wherein the at least one of said conveyor mechanisms comprises multiple round belts.

32. A process of making a unitary spiral package comprising the steps of:

(a) placing a plurality of loads each of which is comprised of a plurality of stacked members on a conveying device in a spaced apart relationship;

(b) transporting each load sequentially to a conveyor assembly positioned within a wrapping apparatus, said conveyor assembly comprising two stacked conveyors the upper of which has an upper portion of its belt supporting the load and moving in a downstream direction; the lower of which has a portion of its belt moving in said downstream direction at the same speed as the other belt;

(c) wrapping a web of stretchable material which has been substantially stretched around said load and conveyor assembly a plurality of times to form a single band engaging the load and portion of the lower conveyor belt moving in a downstream direction;

(d) severing the film from said wrapping apparatus; and (e) activating said conveyor assembly to individually transport the wrapped load and film wrapped around the conveyor assembly at the same speed in a linear direction to a take-off conveying device spaced away from said conveyor assembly.

33. A process as claimed in claim 32 wherein the upper and/or lower conveyor comprises multiple belts.

34. A process as claimed in claim 32 wherein the upper or lower conveyor comprises multiple round belts.

35. A process for making a continuous spiral bundled wrap comprising the steps of:

(a) transporting a plurality of loads into a wrapping area and onto a conveyor assembly comprising a plurality of vertically positioned conveyors positioned within said wrapping area;

(b) causing a web of stretchable film material to be substantially stretched and wrapped around a first load and said conveyor assembly to engage said load and conveyor assembly;

(c) transporting said first load on said conveyor assembly and said web wrapped around said conveyor assembly at the same speed in a linear downstream direction by driving said plurality of vertically positioned conveyors of said conveyor assembly one of which supports said load and another being engaged by the film web;

(d) continuing the wrapping of material around said load and subsequent following loads to form a continuous wrapped bundle;

(e) carrying said continuously wrapped bundle off of said conveyor assembly so that the film web wrapped around said load and conveyor assembly attempts to assume its original memory position containing said load; and (f) cutting said spiral wrapped bundle between said loads to form individually wrapped loads of stacked units.

36. Apparatus for wrapping a plurality of loads, each load comprising a plurality of members and unitizing the loads into wrapped packages comprising: a conveyor assembly adapted to receive a plurality of loads, wrapping means positioned adjacent said conveyor assembly, said wrapping means comprising a frame, a rotatable film dispensing member mounted on said frame, said film dispensing member when rotated defining a wrapping area, said conveyor assembly being positioned within the wrapping area of said film dispensing member, said conveyor assembly comprising two conveyor means mounted to a frame means, one of said conveyor means including belt means to linearly transport a load downstream, the other conveyor means comprising a plurality of belts extending laterally past the edges of said one conveyor adapted to be engaged by a stretched film web deposited by said film dispensing member to transport the web downstream, a rotatable shaft secured to said film dispenser member adapted to hold a roll of material, drive means connected to said film dispensing means to rotate it thereby dispensing material around the said conveyor assembly and the load being carried by said one conveyor means enabling the wrapped load on said one conveyor means and the film web engaged by the other conveyor means to be carried downstream, film stretching means connected to said film dispensing member to place tension on said film material causing said film material to be substantially stretched when wrapped around said load and conveyor assembly, and take-off conveyor means positioned adjacent to said conveyor assembly to carry off the wrapped load.

37. Apparatus as claimed in claim 36 wherein said conveyor means frame means comprises a base plate, guide means mounted to said base plate and a slider member positioned above said base plate.

38. Apparatus as claimed in claim 37 including a plurality of pulley members mounted to said slider member, said pulley members being adapted to hold conveyor belts for rotation thereon while traveling in said guide means.

39. Apparatus as claimed in claim 37 wherein said guide means comprises two parallel channels adapted to receive conveyor belts.

40. Apparatus as claimed in claim 38 wherein said conveyor belts are round.

41. Apparatus as claimed in claim 36 wherein said base plate and said slider member are horizontally positioned with respect to the ground and are parallel to each other.

42. Apparatus as claimed in claim 36 wherein said other conveyor means has belts positioned outside of said one conveyor means belt means with all of said belts being driven by roller drive means.

* * * * *

UNITED STATES PATENT AND TRADEMARK OFFICE

CERTIFICATE OF CORRECTION

PATENT NO. : 4,317,322

DATED : March 2, 1982

INVENTOR(S) : Patrick R. Lancaster, III et al.

It is certified that error appears in the above—identified patent and that said Letters Patent is hereby corrected as shown below:

On The Title Page,

"Attorney, Agent, or Firm-Gipple & Hale; Polster, Polster and Lucchesi" should read -- Attorney, Agent, Or Firm- Gipple & Hale --.

Signed and Sealed this

*Twenty-fifth* Day of *May 1982*

[SEAL]

*Attest:*

*Attesting Officer*

GERALD J. MOSSINGHOFF

*Commissioner of Patents and Trademarks*